US008992644B2

(12) United States Patent
Kodate

(10) Patent No.: US 8,992,644 B2
(45) Date of Patent: Mar. 31, 2015

(54) PLASTIC SOFT COMPOSITION FOR POLISHING AND FOR SURFACE PROTECTIVE MATERIAL APPLICATION

(75) Inventor: Tadao Kodate, Saitama (JP)

(73) Assignee: Joybond Co., Ltd., Saitama (JP)

( * ) Notice: Subject to any disclaimer, the term of this patent is extended or adjusted under 35 U.S.C. 154(b) by 460 days.

(21) Appl. No.: 12/636,481

(22) Filed: Dec. 11, 2009

(65) Prior Publication Data

US 2010/0251624 A1 Oct. 7, 2010

(30) Foreign Application Priority Data

Apr. 1, 2009 (JP) ..... 2009-89001

(51) Int. Cl.

| | |
|---|---|
| ***C09K 3/14*** | (2006.01) |
| ***B24D 3/34*** | (2006.01) |
| ***B24D 3/28*** | (2006.01) |
| ***B24D 11/00*** | (2006.01) |
| ***B24D 13/12*** | (2006.01) |
| ***B24D 13/14*** | (2006.01) |
| ***B24D 15/04*** | (2006.01) |

(52) U.S. Cl.

CPC *B24D 3/346* (2013.01); *B24D 3/28* (2013.01); *B24D 11/00* (2013.01); *B24D 13/12* (2013.01); *B24D 13/147* (2013.01); *B24D 15/04* (2013.01)

USPC ..... 51/298; 51/305; 51/307; 51/308; 51/309

(58) Field of Classification Search

USPC ..... 51/298, 305, 307, 308, 309

See application file for complete search history.

(56) References Cited

U.S. PATENT DOCUMENTS

| | | | | |
|---|---|---|---|---|
| 2,090,708 | A * | 8/1937 | Stahl | 51/306 |
| 2,375,585 | A | 5/1947 | Rimer | |
| 2,523,281 | A | 9/1950 | Currie | |
| 2,589,782 | A | 6/1952 | Creek | |
| 2,825,085 | A | 7/1955 | Ingraham | |
| 2,881,065 | A * | 4/1959 | Reuter | 51/298 |
| 3,065,187 | A | 11/1962 | Vandenberg | |

(Continued)

FOREIGN PATENT DOCUMENTS

| | | |
|---|---|---|
| EP | 0196832 | 5/1992 |
| EP | 0628382 | 12/1994 |

(Continued)

OTHER PUBLICATIONS

Search Report Issued for EP 10290137.8-1262 on Jul. 19, 2010.

(Continued)

*Primary Examiner* — Kaj K Olsen
*Assistant Examiner* — Ross J Christie
(74) *Attorney, Agent, or Firm* — Meyertons, Hood, Kivlin, Kowert & Goetzel, P.C.; Eric B. Meyertons

(57) ABSTRACT

A plastic soft composition is formed of soft base material constantly provided with plasticity, porous fine particles for polishing contained in the base material, and the like, and a polishing process and a coating process are performed to a painted surface and the like using the plastic soft composition. The fine particles for polishing are impregnated with a coating agent (a surface protective agent) added with an activator which is emulsified by contact with water, and the coating agent is held in concave portions formed in the fine particles. Both polishing work and coating work are achieved by sliding the plastic soft composition on a painted surface by a palm pressure of a user.

5 Claims, 2 Drawing Sheets

(56) References Cited

U.S. PATENT DOCUMENTS

| | | | | |
|---|---|---|---|---|
| 3,252,775 | A * | 5/1966 | Tocci-Guilbert | 51/298 |
| 3,520,903 | A | 7/1970 | Pierce | |
| 3,521,412 | A | 7/1970 | McCarty | |
| 3,576,779 | A | 4/1971 | Holdstock et al. | |
| 3,634,973 | A | 1/1972 | McCarty | |
| 3,796,669 | A | 3/1974 | Kiritani et al. | |
| 3,802,024 | A | 4/1974 | Fenster | |
| 3,849,225 | A | 11/1974 | Haertle | |
| 3,897,361 | A | 7/1975 | Saeki et al. | |
| 3,909,217 | A | 9/1975 | Perry | |
| 4,001,140 | A | 1/1977 | Foris et al. | |
| 4,064,061 | A | 12/1977 | Henry | |
| 4,087,376 | A | 5/1978 | Foris et al. | |
| 4,087,943 | A | 5/1978 | Perry | |
| 4,089,802 | A | 5/1978 | Foris et al. | |
| 4,128,972 | A | 12/1978 | Charvat | |
| 4,218,250 | A | 8/1980 | Kasprzak | |
| 4,308,060 | A | 12/1981 | Talbot | |
| 4,343,910 | A | 8/1982 | Busch, Jr. et al. | |
| 4,353,809 | A | 10/1982 | Hoshi et al. | |
| 4,504,283 | A | 3/1985 | Charvat | |
| 4,537,914 | A | 8/1985 | Smith et al. | |
| 4,608,330 | A | 8/1986 | Marabella | |
| 4,664,842 | A | 5/1987 | Knudson et al. | |
| 4,670,500 | A | 6/1987 | Gupta | |
| 4,810,407 | A | 3/1989 | Sandvick | |
| 4,867,757 | A | 9/1989 | Payne | |
| 4,889,285 | A | 12/1989 | Locko | |
| 4,920,704 | A | 5/1990 | Caserta et al. | |
| 5,017,222 | A | 5/1991 | Cifuentes et al. | |
| 5,094,687 | A | 3/1992 | Elepano | |
| 5,174,813 | A | 12/1992 | Cifuentes et al. | |
| 5,203,883 | A | 4/1993 | Perry | |
| 5,476,416 | A | 12/1995 | Kodate | |
| 5,500,049 | A | 3/1996 | Kolinsky | |
| 5,676,714 | A | 10/1997 | Kodate | |
| 5,691,049 | A | 11/1997 | Morita et al. | |
| 5,716,259 | A | 2/1998 | Miller | |
| 5,727,990 | A | 3/1998 | Hasegawa et al. | |
| 5,727,993 | A | 3/1998 | Kodate | |
| 5,903,951 | A | 5/1999 | Ionta et al. | |
| 5,904,758 | A | 5/1999 | Kucala | |
| 5,915,436 | A | 6/1999 | Johnson et al. | |
| 5,919,549 | A | 7/1999 | Van et al. | |
| 5,928,064 | A | 7/1999 | Miller | |
| 5,968,238 | A | 10/1999 | Healy et al. | |
| 6,241,579 | B1 | 6/2001 | Miller et al. | |
| 6,286,498 | B1 | 9/2001 | Sung | |
| 6,342,002 | B1 | 1/2002 | Wang | |
| 6,390,890 | B1 | 5/2002 | Molnar | |
| 6,494,767 | B2 | 12/2002 | Fisher | |
| 6,547,643 | B1 | 4/2003 | Miller, III et al. | |
| 6,551,974 | B1 | 4/2003 | Conrad et al. | |
| 6,565,615 | B1 | 5/2003 | Wong et al. | |
| 6,585,574 | B1 | 7/2003 | Lombardo et al. | |
| 2004/0247852 | A1 * | 12/2004 | Kume et al. | 428/304.4 |
| 2006/0226626 | A1 * | 10/2006 | Dehn et al. | 280/220 |
| 2008/0181855 | A1 * | 7/2008 | Jablow | 424/49 |

FOREIGN PATENT DOCUMENTS

| | | |
|---|---|---|
| GB | 836794 | 6/1960 |
| GB | 1518431 | 7/1978 |
| JP | 2-66956 | 5/1990 |
| JP | 04-11335 | 2/1992 |
| JP | 06-93298 | 5/1994 |
| JP | 08-41444 | 2/1996 |
| WO | 96/15877 | 5/1996 |
| WO | 2008/142093 | 11/2008 |

OTHER PUBLICATIONS

Office Action issued for JP counterpart application No. JP2009-089001.

Webster's Ninth New Collegiate Dictionary, Merriam-Webster Inc., 1988., p. 900.

* cited by examiner

PLASTIC SOFT COMPOSITION FOR POLISHING AND FOR SURFACE PROTECTIVE MATERIAL APPLICATION

CROSS-REFERENCE TO RELATED APPLICATION

The present application claims priority from Japanese Patent Application No. JP 2009-89001 filed on Apr. 1, 2009, the content of which is hereby incorporated by reference into this application.

BACKGROUND OF THE INVENTION

1. Field of the Invention

The present invention relates to a plastic soft composition for polishing and for surface protective material application, and in particular to an effective technique in application to a plastic soft composition used for removing extraneous matter from a portion required for surface beauty, such as a painted surface of a vehicle, and applying surface protective material thereto.

2. Description of the Relevant Art

When coating mist, iron powder, powder dust, and smoke dust, which are generated from a factory and the like, volcano dust, yellow sand, tar pitch and the like flies toward a painted surface of a vehicle and the like, it adheres thereto as a small projection. Unless such an extraneous matter is removed by periodic wiping and the like, it falls in a firmly-attached state, so that it becomes difficult in some cases to wipe off the extraneous matter only by performing wiping-off with cloth containing detergent.

As means for removing such an extraneous matter, there is means for performing removal by polishing with compound and a sand paper, but when a face to be polished is a painted surface, there is such a concern that the face to be polished may be scratched. As a technique for preventing occurrence of such scratches on a face to be polished, Japanese Patent Application Publication No. 04-11335 discloses a plastic soft grinding stone obtained by mixing silica sands with a predetermined particle diameter or fine particles for polishing made of calcium carbonate into soft base material with plasticity at a use time. When the plastic soft grinding stone is pressed onto a face to be polished, fine particles for polishing on a portion contacting with the face to be polished are evenly pressed to enter the soft base material, so that even if the plastic soft grinding stone is slid on the face to be polished in a contacting state thereof, the face to be polished is prevented from being scratched.

In a polishing work using the abovementioned plastic soft grinding stone, an extraneous matter on the face to be polished enters the soft base material while being sunk into the soft base material. When the plastic soft grinding stone is slid on the face to be polished in the state, the extraneous matter on the face to be polished advances in the soft base material in a cutting manner and collides against the fine particles for polishing on the way. Even if the fine particles for polishing collide against the extraneous matter on the face to be polished, they are not pushed by the extraneous matter, so that the extraneous matter on the face to be polished is polished and removed by the collision. The removed extraneous matter on the face to be polished stays in the base material of the plastic soft grinding stone as it is.

However, the plastic soft grinding stone accumulates extraneous matters removed from the face to be polished in the soft base material due to repetitive use thereof and finally reaches a state where polishing cannot be performed using fine particles for polishing. Therefore, if necessary, it is required to remix the soft base material so as to move a used surface layer portion to the inside of the plastic soft grinding stone to form a fresh surface layer portion. Since efficiency lowering of polishing work takes place due to frequent implementation of such a remixing work, Japanese Patent Application Laid-Open Publication No. 08-41444 discloses a technique which allows reduction of the number of the remixing works.

Japanese Patent Application Laid-Open Publication No. 06-344267 discloses a technique which allows removal of not only a projecting extraneous matter on a face to be polished but also a flat extraneous matter thereof in the polishing using the abovementioned plastic soft grinding stone.

SUMMARY OF THE INVENTION

An agent with cleaner effect of waxes, surface protective agents and the like used to a painted surface of a vehicle and the like contains a polishing agent. In a so-called "pastry wax", a polishing agent is contained not only as a cleaning component but also as a bulking agent. Since a polishing agent is also contained in liquid-type wax for the same purpose as the above and it is easily precipitated, the liquid-type wax is used after a container where the liquid-type wax is accommodated is agitated to diffuse the polishing agent in the liquid-type wax evenly as a whole.

Surface protective effect is obtained by performing "waxing" of applying a wax to a painted surface of a vehicle and the like and by causing a sponge and the like to contain a wax and a surface protective agent to apply the same and then wiping off the applied wax and surface protective agent after being dried.

Now, in such an applying method of a wax and a surface protective agent using a sponge and the like as described above, application unevenness may occur due to such a fact that the wax and surface protective agent is unevenly contained in the sponge and a load applied to a face to be applied at an application time becomes uneven, and due to the influence of a motion function and the like of a polishing agent contained in the wax and the surface protective agent. When a face to be applied is a painted surface of a vehicle and the like, differences among coating methods, such as baking finish, lacquer finishing, enamel coating, aqueous coating, powder coating and the like further complicate application work of a wax and a surface protective agent.

A solvent is contained in the wax and the surface protective agent in addition to the abovementioned polishing agent. Therefore, when a face to be applied is a painted surface of a vehicle and the like and if an applied paint film has been degraded, such a drawback that a so-called "bleaching" where a solvent acts on the degraded paint film and chemical change of the degraded paint film occurs takes place so that the painted surface is melted is apprehended. Such a drawback is apprehended especially when the painted surface is a painted surface repaired by spraying.

An embodiment is directed to a technique where a protective agent such as a wax and a surface protective agent can be applied to a face without damaging the face.

Another embodiment is directed to a technique where an extraneous matter on a portion required for surface beauty, such as a painted surface of a vehicle can be removed without damaging the portion.

Embodiments disclosed in this application will be briefly described as follows.

A plastic soft composition for polishing and for surface protective agent application includes:

a soft base material with plasticity;

porous fine particles for polishing mixed in the soft base material; and a surface protective agent held in hole portions of the fine particles for polishing, in which the surface protective agent is applied to the face to be polished while the fine particles for polishing are removing extraneous matter attached on the face to be polished therefrom by bringing the plastic soft composition into contact with a face to be polished and sliding the plastic soft composition along the face to be polished.

The effects obtained by embodiments described herein will be briefly described below.

By forming plastic soft composition from soft base material containing porous fine particles for polishing impregnated with coating agent and performing a polishing process and a coating process to a painted surface required for surface beauty and the like using the plastic soft composition, the polishing process and the coating process can be implemented without damaging the coating face and the like.

Since polishing is performed without damaging a painted surface and the like and a coating process can be further performed, surface beauty of the painted surface and the like can be maintained.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
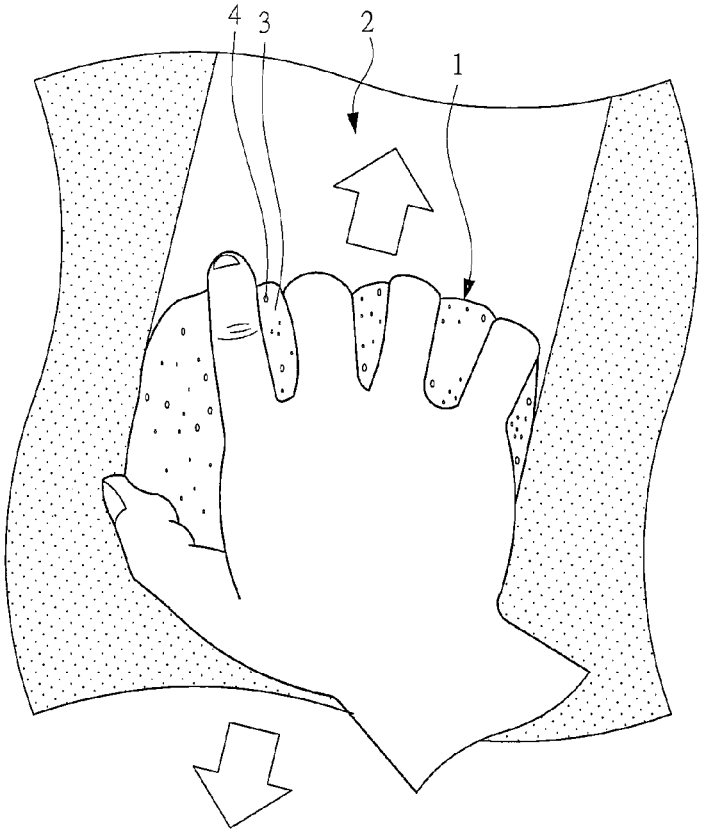
FIG. 1 is a perspective view showing a use state of a plastic soft composition.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, in the embodiments described below, when referring to the number of elements (including number of pieces, values, amount, range, and the like), the number of the elements is not limited to a specific number unless otherwise stated or except the case where the number is apparently limited to a specific number in principle. The number larger or smaller than the specified number is also applicable.

In the embodiments described below, of course, constituent elements (including elementary steps and the like) thereof are not necessarily essential expect for such a case that it is apparently specified that a constituent element is essential, such a case that it is thought that a constituent element is apparently essential in principle, and the like. Regarding constituent elements and the like in examples and the like, it goes without saying that such an expression "B comprising A" or "B including A" does not exclude a constituent element other than "A", except for the case that it is apparently specified that "B" includes only "A" and the like.

Similarly, in the embodiments described below, when the shape of the components, positional relation thereof, and the like are mentioned, the substantially approximate and similar shapes and the like are included therein unless otherwise stated or except the case where it can be conceived that they are apparently excluded in principle. The same goes for the numerical value and the range described above.

When materials and the like are mentioned, a specified material is a main material and it does not exclude a subsidiary element, an additive, additional element, and the like except for the case that it is clearly specified that a specified material is not a main material or the case that a specified material is not a main material in principle or in view of the circumstances.

Also, components having the same function are denoted by the same reference symbols throughout the drawings for describing the embodiment, and the repetitive description thereof will be omitted.

In figures used in the embodiment, even when a figure is a plan view, it may be partially hatched for facilitating visualization.

A plastic soft composition according to an embodiment is one used for polishing and for surface protective material application to a painted surface of a vehicle, such as, for example, an automobile.

Figure 2:
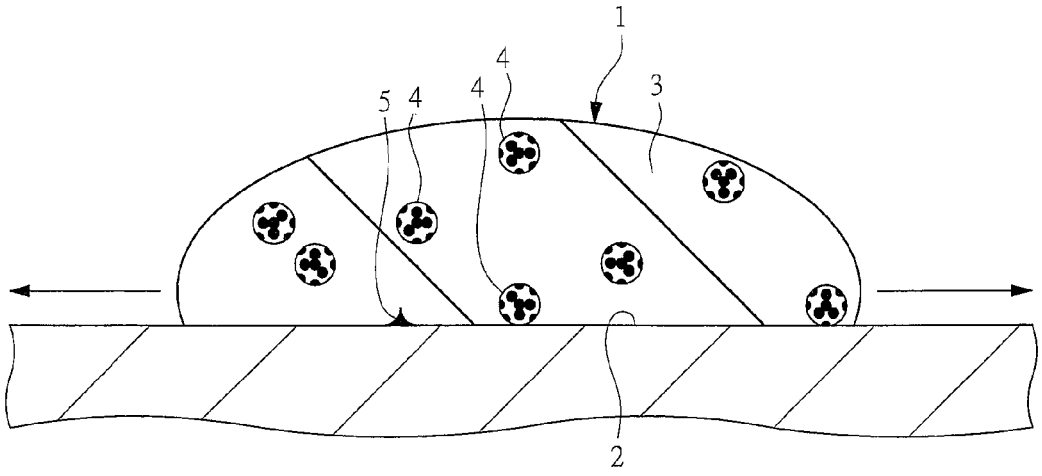
FIG. 2 is a sectional view showing the use state of the plastic soft composition.

FIG. 1 and FIG. 2 are a perspective view and a sectional view that show a use state of a plastic soft composition according to the embodiment, respectively. As shown in FIG. 1 and FIG. 2, a plastic soft composition 1 according to the embodiment is used in such a manner that it is brought into contact with a painted surface (a face to be polished) 2 and slid thereon in a reciprocating manner.

The plastic soft composition 1 according to the embodiment is formed from a base material which is soft (a soft base material) 3 with plasticity, fine particles for polishing 4 contained in the base material 3, and the like.

The base material 3 is formed from a material constantly provided with plasticity regardless of use time and non-use time, and it may be petroleum resin such as polyolefin polyol as an example. When removal of an oil film attached on the painted surface (a face to be polished) 2 and surface polishing of the painted surface 2 such as wide rust removal is performed, oily putty, viscoelastic material, or oil putty or viscoelastic material added with plastic material properly may be used as the base material 3.

A material for fine particles for polishing 4 may be preferably a porous material with relatively high hardness, and it may be calcium carbonate, quartz, silicon carbide (emery sand), compound, ceramics, green carborundum, and the like as examples. As a material for the fine particles for polishing 4 contained in the base material 3, one or more can be selected from the abovementioned materials according to application of the plastic soft composition 1, a state of a painted surface 2, and a material and an attached state of a projection 5 which is attached on and to be removed (polished) from the painted surface 2. Particle diameters of fine particles for polishing 4 can be set to fall within a range from about 3 μm to about 50 μm as an example. This is because such a drawback is apprehended that when the particle diameter is less than about 3 μm, polishing force becomes insufficient and when the particle diameter is larger than about 50 μm, a catch on a contact face (a painted surface 2) occurs.

Figure 3:
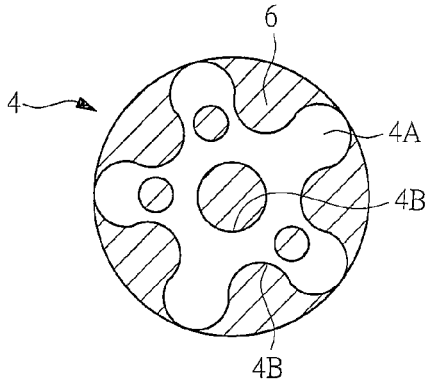
FIG. 3 is an explanatory view showing a fine particle for polishing contained in the plastic soft composition.

Here, FIG. 3 is an explanatory view that shows details of the fine particle for polishing 4. As described above, the porous fine particle for polishing 4 includes a convex portion 4A, a concave portion 4B (hole portion), and a cavity (a hole portion (not shown)) which is formed inside the fine particle for polishing 4 and is continuous to or discontinuous to the concave portion 4B. The concave portion 4B and the cavity include a crack which has occurred in the fine particle for polishing 4. The fine particle for polishing 4 is impregnated with a coating agent (a surface protective agent) 6, and the coating agent 6 is held in the concave portion 4B and the cavity. As the coating agent 6, at least one selected from a group of wax imparting gloss to the painted surface 2, a waterproof agent (an anticorrosive agent) imparting water-repellent effect to the painted surface 2, and a dirt-preventing agent imparting release effect of preventing a contaminated material (a projection 5) from attaching to the painted surface 2 can be exemplified. Specific materials for the coating agent 6 will be described together with usage thereof.

Figure 4:
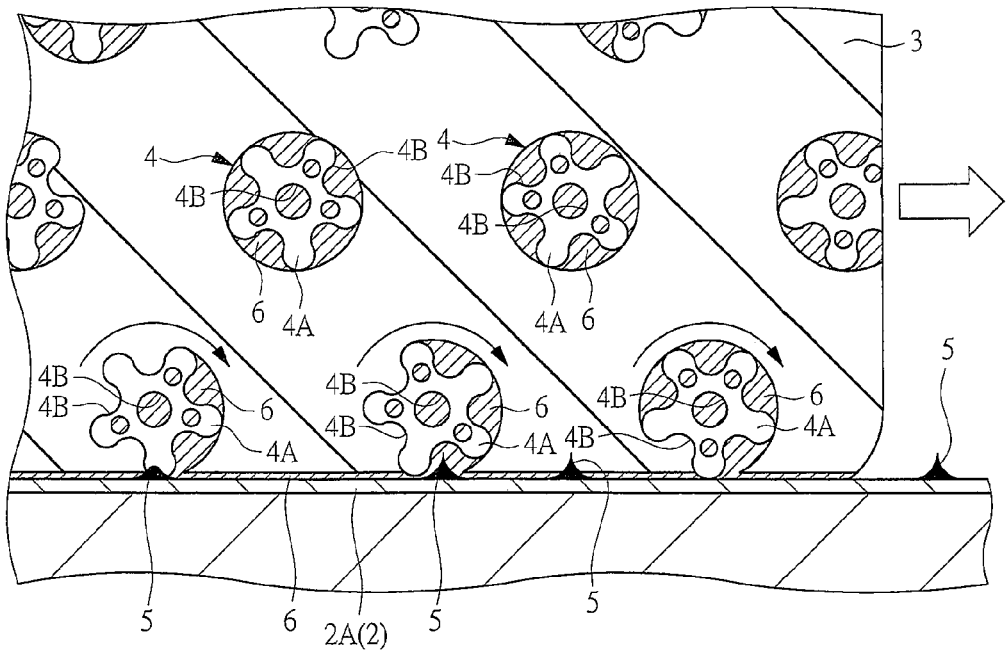
FIG. 4 is an explanatory view showing motions of fine particles for polishing during use of the plastic soft composition.

Next, the function of the fine particles for polishing 4 and a state of the painted surface 2 during polishing of the painted surface 2 using the plastic soft composition 1 will be explained with reference to FIG. 4.

The plastic soft composition 1 is pressed onto a painted surface 2 while being grasped by a hand and fingers of a user and contaminated materials (projections 5) attached to the painted surface 2, such as coating mist, iron powder, powder dust, smoke dust, volcano dust, yellow sand, pitch tar, and the like are removed in a polishing manner by rubbing the plastic soft composition 1 against in a sliding manner by a palm pressure of the user. Reaction force (load) to the palm pressure acts on a contact face between the plastic soft composition 1 and the painted surface 2 evenly in plane so that the fine particles for polishing 4 are pushed into the base material 3 on the contact face. Since a reaction force to the palm pressure acts on the fine particles for polishing 4 pushed into the base material 3, the fine particles for polishing 4 do not project from the contact face of the base material 3 with the painted surface 2, so that, even if the plastic soft composition 1 is brought into contact with the painted surface 2 and moved in a rubbing manner, the painted surface 2 applied with a paint film 2A is prevented from being scratched. Therefore, when the plastic soft composition 1 is brought into contact with the painted surface 2 and moved in a rubbing manner along directions indicated by thick arrows shown in FIG. 1 and FIG. 4, the fine particles for polishing 4 are rotated according to frictional force received thereby. At this time, the contaminated materials (projections 5) are caught by the concave portions 4B of the fine particles for polishing 4 and polished so that they are removed from the painted surface 2. When the removed contaminated materials are accumulated on a surface layer portion of the base material 3, reattaching of the removed contaminated materials to the painted surface 2 and damaging of the painted surface 2 by the removed contaminated materials can be prevented by remixing the base material 3 such that the surface layer portion is positioned inside the base material 3 to form a fresh surface layer portion in the base material 3.

The fine particles for polishing 4 not only polishes contaminated materials (projections 5) away but also apply the coating agent 6 held in the concave portions 4B to the painted surface 2 while rotating according to the reception of frictional force. As described above, since the reaction force to the palm pressure acts on the contact face between the plastic soft composition 1 and the painted surface 2 evenly in plane, the coating agent 6 can be applied to the painted surface 2 evenly. Further, since extremely-fine scratches are formed on the painted surface 2 by polishing of the painted surface 2 using the fine particles for polishing 4, which is so-called "sanding", the coating agent 6 enters the scratches so that the coating agent 6 is promoted to closely contact with the painted surface 2.

Here, situation of application of the coating agent 6 to the painted surface 2 will be explained in further detail.

The coating agent 6 is added with, for example, an active agent which is emulsified by contacting with water. Therefore, by performing polishing while supplying water to the contact face between the plastic soft composition 1 and the painted surface 2 at a polishing time of the painted surface 2, a surface of the plastic soft composition 1 (the base material 3) is emulsified so that the surface of the plastic soft composition 1 melts to the painted surface 2 in a small amount. At this time, the fine particles for polishing 4 in the base material 3 are liberated from the base material 3 to project from the base material 3, but, because a reaction force to the palm pressure acts on the contact face between the plastic soft composition 1 and the painted surface 2 evenly in plane, as described above, a polishing state within the painted surface 2 can be prevented from being uneven. Note that, if the base material 3 is made of hard material which is not soft, such as a grinding stone, when the painted surface 2 is formed in a curved shape, the contact face between the plastic soft composition 1 and the painted surface 2 becomes small and the palm pressure concentrates on one point so that it becomes difficult to conduct even polishing within the painted surface 2. By selecting a desired kind and a desired amount of an activator for emulsification in advance properly, a dissolution rate of the plastic soft composition 1 becomes able to be adjusted, so that a polishing effect obtained by the fine particles for polishing 4 becomes able to be adjusted.

As described above, by adjusting the dissolving rate of the plastic soft composition 1, even when a high polishing effect is expected together with application of the coating agent 6, the expectation can be satisfied, but the number of fine polishing scratches occurring on the painted surface 2 increases according to improvement of the polishing effect. Therefore, by selecting a material having a wax effect or a coating effect where the material can be filled in the polishing scratches as the coating agent 6, the polishing scratches are filled with the coating agent 6, so that beauty effect of the painted surface 2 can be maintained for a long period. In the embodiment, as the coating agent 6 having such a work effect or a coating effect, a resin material containing at least one selected from the group consisting of silicon oil, carnauba wax, micro wax, fluorine compound, titanium oxide, polyester, epoxy and silica materials can be exemplified.

Now, the term "emulsification or emulsifying" in the embodiment has the following two meanings. As described above, one is used for applying the coating agent 6 to the painted surface 2 to bring the former into closely contact with the latter thereby protecting the painted surface 2. The other is used for conducting liberation of the fine particles for polishing 4 from the base material 3 at a polishing time of the painted surface 2 performed by the plastic soft composition 1. the abovementioned activator can be adopted to realize only one of the two meanings. Thus, activator realizing only one of the emulsifications can be used alone and both of the emulsifications can be realized using a plurality of activators. It goes without saying that an activator which can realize both of the emulsifications can be used alone.

The surface of the plastic soft composition 1 (the base material 3) can be emulsified at a polishing time of the painted surface 2 by performing polishing while supplying the activator to the contact face between the plastic soft composition 1 and the painted surface 2 together with water without adding the activator to the coating agent 6 in advance. Even when such a method is adopted, an effect similar to the case that the activator is added to the coating agent 6 in advance can be obtained. Even if the fine particles for polishing 4 are impregnated with the coating agent 6 emulsified by addition of the activator and water in advance, a similar effect can be obtained.

Now, when a solvent is contained in the coating agent 6, such a drawback is apprehended that, when the applied paint film 2A (see FIG. 4) on the painted surface 2 has been degraded, the solvent acts on the paint film 2A to cause chemical change in the paint film 2A so that the painted surface 2 (the applied paint film 2A) is melted. Such a drawback is similarly apprehended in the case that the painted surface 2 is a painted surface which has been repaired by spraying. On the other hand, a feature of the plastic soft composition 1 (the coating agent 6) in the embodiment lies in that it does not contain a volatile solvent. Therefore, polishing and application of the coating agent 6 using the plastic soft composition 1 of the embodiment can prevent such a drawback that the painted surface 2 (the applied paint film 2A) is melted to be degraded. Since the degradation of the painted surface 2 (the applied paint film 2A) can be prevented, application unevenness of the coating agent 6 can be prevented from occurring due to degradation of the painted surface 2. As described above, since the fine particles for polishing 4 contained in the plastic soft composition 1 of the embodiment are impregnated with the coating agent 6 and the coating agent 6 is added with the activator which is emulsified due to contact with water, the surface of the plastic soft composition 1 (the base material 3) is emulsified at a time when the plastic soft composition 1 (the base material 3) is brought into contact with the painted surface 2 while water is supplied to the plastic soft composition 1 (the base material 3), so that even application of the coating agent 6 to the painted surface 2, namely, even wax application or even coating process can be realized.

In general, when coating is performed to a painted surface and the like for protecting the painted surface and the like, well-looking and even coating cannot be performed if a contaminated material and oily component remains on the painted surface, so that it is necessary to remove the contaminated material and oily component on the painted surface prior to the coating process in advance, and coating performance maintenance depends on whether the removing processing is good or bad. Therefore, the removing processing of a contaminated material and oily component requires nervous work. On the other hand, when the plastic soft component 1 of the embodiment is used, as described above, the porous fine particles for polishing 4 are impregnated with the coating agent 6 added with the activator which is emulsified due to contact with water, so that the coating agent 6 melts out simultaneously with the polishing work and is applied to the painted surface 2, and the painted surface 2 is coated with the coating agent 6. This is achieved by utilizing such a characteristic that the concave portions 4B and the cavities in the fine particles for polishing 4 can store the coating agent 6, and both the polishing work and the coating work can be performed by using the plastic soft composition 1 of the embodiment containing such fine particles for polishing 4, so that both the polishing effect and the coating effect can be simultaneously achieved. Though various materials are described for a material for the fine particles for polishing 4, it is especially preferable that calcium carbonate is used as the material for the fine particles for polishing 4 in view of formation easiness in porous shape and manufacturing cost.

Now, development of vehicles with reduced gas mileage has gone ahead worldwide, but the maximum target which can be improved for improvement of gas mileage is to reduce a weight of a body of a vehicle. As materials used as a weight-reduced body, aluminum, duralumin, fiber reinforced plastics (FRP), and carbon fiber (carbon) can be exemplified as representative examples. Unlike iron, aluminum is high in expansion coefficient, so that as a paint used for painting a surface of an aluminum body, one which can follow the expansion coefficient of the aluminum body is required. Therefore, when a paint to be painted to an iron plate and a steel plate is applied to aluminum, cracks occur in the paint because the expansion coefficient of the aluminum is high, which results in occurrence of many troubles. A paint which can follow the expansion of aluminum has flexibility and scratches occur on the painted surface 2 easily due to its softness, so that, when polishing is performed in order to remove the scratches, polishing grinding particles bit in the painted surface 2, which results in that it is much difficult to polish the painted surface 2 into a mirror face state by an ordinary polishing method. In order to polish such a paint, it is necessary to conduct rotation of a motor in a polisher at a low speed, thereby preventing frictional heat from being generated. Now, the expansion coefficient of resin used for molding a body, such as FRP and carbon fiber (carbon) other than aluminum can be considered in the same manner as aluminum. As the resin to be used, epoxy excellent in adhesion is frequently used, but the epoxy is weak in ultraviolet and degradation thereof is rapid. Therefore, the degradation is suppressed by using a top coat (clear paint) made of polyester resin. However, the fact that a paint is soft means that the paint tends to scar. A surface of FRP is painted with the top coat, but there is the case that paint is not performed on carbon in order to express beauty effect and even if painting is performed, a transparent clear paint is used. That is, paints to be used for an iron plate and a steel plate cannot be used. From the above reasons, since the painted surface 2 can be prevented from being ground down beyond necessity and frictional heat can be prevented from being generated by using the plastic soft composition 1 of the embodiment for maintenance of the painted surface 2 of the weight-reduced body having various features, the pained surface 2 of the weight-reduced body can be prevented from being degraded. Further, by using the plastic soft composition 1 of the embodiment, the coating agent 6 can be applied to the painted surface 2, so that the beauty effect of the painted surface 2 can be continued by utilizing wax coating.

When commercially-available waxes are used, there is such a concern that polishing agents contained in the waxes are released and act on the applied paint film 2A of the painted surface 2 regardless of a painted color and the kind of a paint of the applied paint film 2A of the painted surface 2, which results in deepening of scratches on the painted surface 2 and such a concern increases especially when the painted surface 2 is for the abovementioned weight-reduced body. On the other hand, as described above, a desired kind and a desired amount of an activator to be added are properly selected in advance according to a paint color or the kind of a paint of the applied paint film 2A of the painted surface 2 in the plastic soft composition 1 of the embodiment. Thereby, a release amount of the polishing agent can be controlled so that a proper polishing performance can be achieved.

According to the abovementioned embodiment, since the plastic soft composition 1 is made from soft base material 3 containing the porous fine particles for polishing 4 impregnated with the coating agent 6, and the painted surface 2 of a vehicle such as an automobile is polished using the plastic soft composition 1, and besides, application of the coating agent 6 is performed, application of the coating agent 6 can be performed without damaging the painted surface 2. Since polishing and, further, coating process can be performed without damaging the painted surface 2, surface beauty of the painted surface 2 can be maintained.

In the foregoing, the invention made by the inventors of the present invention has been concretely described based on the embodiments. However, it is needless to say that the present invention is not limited to the foregoing embodiments and various modifications and alterations can be made within the scope of the present invention.

In the embodiment, the case that a portion to which polishing and coating are applied is a painted surface of a vehicle such as an automobile has been exemplified, but similar polishing and coating process can be similarly applied to a glass, a sash, and the like which require maintenance of surface beauty without damaging them.

The plastic soft composition for polishing and for surface protective material application of the present invention can be widely applied to a polishing process and a coating process to a portion requiring maintenance of surface beauty.

What is claimed is:

1. A plastic soft composition for polishing and for surface protective material application comprising:

a soft base material with plasticity;

porous fine particles for polishing mixed in the soft base material, wherein each of the fine particles for polishing has hole portions;

a surface protective agent held in at least some of the hole portions of the fine particles for polishing, the surface protective agent, during use of the plastic soft composition, being applied to the surface polished by the fine particles for polishing; and an active agent at least partially contained in the hole portions of the fine particles for polishing, wherein the active agent is emulsified by contact with water during use of the plastic soft composition, wherein the soft base material is adapted to support the fine particles for polishing so that the fine particles for polishing removes extraneous matter attached on the surface and applies the surface protective agent and the active agent to the surface when the plastic soft composition is slidably moved with respect to the surface.

2. The plastic soft composition for polishing and for surface protecting material application according to claim 1, wherein the surface protecting agent is emulsified in water during use of the plastic soft composition.

3. The plastic soft composition for polishing and for surface protecting material application according to claim 1, wherein the surface protecting agent imparts at least one of: gloss, a water-repelling effect, a release effect preventing attachment of a contaminated material to the face to be polished, and a coating effect for performing filling in polishing scratches generated on the face to be polished.

4. The plastic soft composition for polishing and for surface protecting material application according to claim 3, wherein the surface protecting agent is a resin material containing at least one selected from a group consisting of silicon oil, carnauba wax, micro wax, fluorine compound, titanium oxide, polyester, epoxy and silica materials.

5. The plastic soft composition for polishing and for surface protecting material application according to claim 1, wherein the fine particles for polishing are composed of at least one compound selected from the group consisting of: quartz, calcium carbonate, silicon carbide (emery sand), polishing compound, ceramics, and green carborundum.

* * * * *